US008016613B2

(12) United States Patent
Paglia et al.

(10) Patent No.: US 8,016,613 B2
(45) Date of Patent: Sep. 13, 2011

(54) COAXIAL CONNECTOR WITH LOCKING SLEEVE FOR TERMINATING CABLE

(75) Inventors: Richard Paglia, Wallingford, CT (US); Weixing Chen, Cangzhou (CN); Minghua Gu, Chaozhou (CN)

(73) Assignee: Amphenol Corporation, Wallingford, CT (US)

( * ) Notice: Subject to any disclaimer, the term of this patent is extended or adjusted under 35 U.S.C. 154(b) by 54 days.

(21) Appl. No.: 12/616,931

(22) Filed: Nov. 12, 2009

(65) Prior Publication Data

US 2011/0111626 A1 May 12, 2011

(51) Int. Cl.
*H01R 9/05* (2006.01)

(52) U.S. Cl. ..... 439/578

(58) Field of Classification Search ..... 439/578, 439/583, 584, 585

See application file for complete search history.

(56) References Cited

U.S. PATENT DOCUMENTS

| | | | | |
|---|---|---|---|---|
| 5,470,257 | A | 11/1995 | Szegda | |
| 5,632,651 | A | 5/1997 | Szegda | |
| 6,331,123 | B1 * | 12/2001 | Rodrigues | 439/584 |
| 6,530,807 | B2 | 3/2003 | Rodrigues et al. | |
| 6,767,247 | B2 | 7/2004 | Rodrigues et al. | |
| D505,391 | S | 5/2005 | Rodrigues et al. | |
| D535,259 | S | 1/2007 | Rodrigues et al. | |
| 7,192,308 | B2 | 3/2007 | Rodrigues et al. | |
| 7,241,172 | B2 * | 7/2007 | Rodrigues et al. | 439/578 |
| 7,455,549 | B2 * | 11/2008 | Rodrigues et al. | 439/578 |
| 7,458,849 | B2 | 12/2008 | Rodrigues et al. | |
| 7,794,275 | B2 | 9/2010 | Rodrigues | |
| 2005/0255735 | A1 | 11/2005 | Ward | |
| 2007/0093128 | A1 | 4/2007 | Thomas et al. | |
| 2008/0261445 | A1 | 10/2008 | Malloy et al. | |
| 2008/0274644 | A1 | 11/2008 | Rodrigues | |
| 2009/0280668 | A1 * | 11/2009 | Rodrigues | 439/271 |

* cited by examiner

*Primary Examiner* — Neil Abrams
(74) *Attorney, Agent, or Firm* — Blank Rome LLP

(57) ABSTRACT

A connector for terminating a coaxial cable that comprises a connector body that has a first end adapted to receive the coaxial cable and a second end adapted to couple with a mating connector. A locking sleeve that has an interface end is engageable with the first end of the connector body. The locking sleeve includes an outer engagement ring spaced from the interface end thereby defining an outer annular receiving area between the outer engagement ring and the interface end. The outer annular receiving area is configured to receive the first end of the connector body in an interference fit. The locking sleeve is axially moveable relative to the connector body between a holding position in which the locking sleeve is detachably coupled to the connector body and a locked position in which the locking sleeve is inseparably coupled to the connector body.

22 Claims, 4 Drawing Sheets

COAXIAL CONNECTOR WITH LOCKING SLEEVE FOR TERMINATING CABLE

FIELD OF THE INVENTION

The present invention generally relates to a coaxial connector for terminating coaxial cables. More specifically, the present invention relates to a coaxial connector with a locking sleeve that couples to a connector body for terminating a prepared end of a cable.

BACKGROUND OF THE INVENTION

Conventional coaxial connectors typically include a connector body with an inner post that is inserted between the insulator and the shield or braid of the prepared end of a coaxial cable. Conventional connectors also usually include a locking sleeve that locks the connector on the prepared end of the cable. The locking sleeve, however, can be lost or misplaced during shipping and installation. To solve this problem, some conventional connectors have an integral or inseparable locking sleeve and connector body. Other conventional connectors have a locking sleeve that is detachable and reattachable to the connector body.

Examples of prior art coaxial connectors include U.S. Pat. No. 5,470,257 to Szegda, U.S. Pat. No. 5,632,651 to Szegda, U.S. Pat. No. 7,192,308 to Rodrigues et al., and U.S. Pat. No. 7,458,849 to Rodrigues et al., the subject matter of each of which is hereby incorporated by reference.

SUMMARY OF THE INVENTION

Accordingly, an embodiment of the present invention relates to a connector for terminating a coaxial cable that comprises a connector body that has a first end adapted to receive the coaxial cable and a second end adapted to couple with a mating connector. A locking sleeve that has an interface end is engageable with the first end of the connector body. The locking sleeve includes an outer engagement ring spaced from the interface end thereby defining an outer annular receiving area between the outer engagement ring and the interface end. The outer annular receiving area is configured to receive the first end of the connector body in an interference fit. The locking sleeve is axially moveable relative to the connector body between a holding position in which the locking sleeve is detachably coupled to the connector body and a locked position in which the locking sleeve is inseparably coupled to the connector body.

An embodiment of the present invention may also relate to a connector for terminating a coaxial cable that comprises a connector body that has a first end adapted to receive the coaxial cable and a second end adapted to couple with a mating connector. A locking sleeve that has an interface end that is engageable with the first end of the connector body. The locking sleeve includes an outer engagement ring spaced from the interface end and at least one frangible member is disposed between the outer engagement ring and the interface end. The outer engagement ring is configured to engage the first end of the connector body in an interference fit. The locking sleeve is axially moveable relative to the connector body between a holding position in which the locking sleeve is detachably coupled to the connector body and a locked position in which the locking sleeve is inseparably coupled to the connector body.

An embodiment of the present invention may also relate a connector for terminating a coaxial cable that comprises a connector body that has a first end adapted to receive the coaxial cable and a second end adapted to couple with a mating connector. A plurality of gripping members extend from an outer surface of the first end of the connector body. A locking sleeve that has an interface end is engageable with the first end of the connector body. The locking sleeve includes an outer engagement ring spaced from the interface end. An outer annular receiving area is defined between the outer engagement ring and the interface end of the locking sleeve. The outer annular receiving area is configured to receive the first end of the connector body such that the plurality of gripping members of the outer engagement ring engage the first end of the connector body in an interface fit. A plurality of the frangible members extend between the interface end of the locking sleeve and the outer engagement ring. The locking sleeve is axially moveable relative to the connector body between a holding position in which the locking sleeve is detachably coupled to the connector body and a locked position in which the locking sleeve is inseparably coupled to the connector body.

An embodiment of the present invention may also relate to a method for terminating a coaxial cable that comprises the steps of providing a connector including a connector body with opposite first and second ends and a locking sleeve with an interface end, an outer engagement ring, and at least one frangible member therebetween; inserting an end of the coaxial cable through the locking sleeve; inserting the end of the coaxial cable through the connector body; coupling the interface end of the locking sleeve with a first end of the connector body via an interference fit; inserting the locking sleeve into the connector body; and moving the locking sleeve axially relative to the connector body until the frangible member of the locking sleeve is severed, thereby detaching the outer engagement ring from the locking sleeve, and allowing the locking sleeve to move axially to a locked position.

Other objects, advantages and salient features of the invention will become apparent from the following detailed description, which, taken in conjunction with the annexed drawings, discloses a preferred embodiment of the present invention.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE INVENTION

Referring to FIGS. 1-4A, 4B, 5A, and 5B, an exemplary embodiment of the present invention relates to a coaxial connector 100 for terminating a cable C. The connector 100 generally includes a connector body 110, a locking sleeve 120 attachable to the connector body 110, and a coupling nut 130 adapted to mate to a mating connector (not shown). The locking sleeve 120 preferably moves axially with respect to the connector body 110 between a first holding position (FIG. 5A) and a second locked position (FIG. 5B) for securing the connector 100 to the end of the cable. The locking sleeve 120 and the connector body 110 cooperate in an interference fit such that the locking sleeve 120 will not be lost or misplaced during shipping and installation of the connector 100. The interference fit also allows the locking sleeve 120 to be easily separated from the connector body 110 either by hand or by using an appropriate tool.

Figure 1:
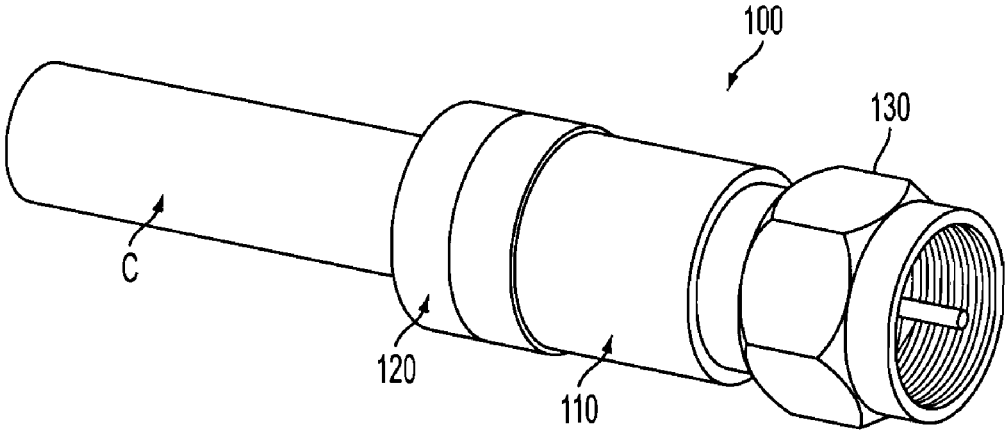
FIG. 1 is a perspective view of a coaxial connector in accordance with an embodiment of the present invention, showing the connector terminating the end of a coaxial cable.
Figure 2:
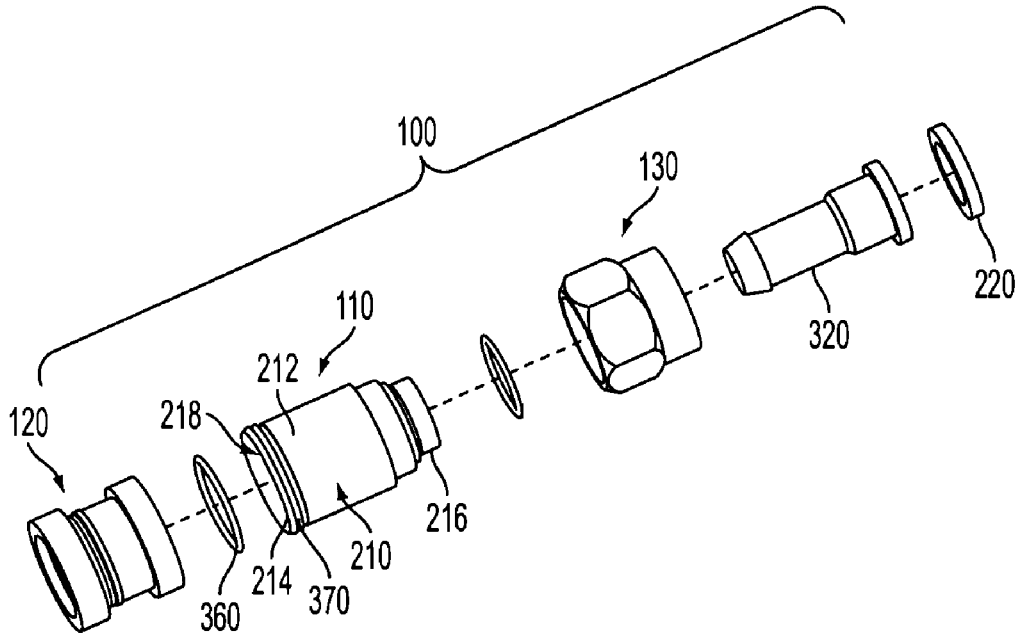
FIG. 2 is an exploded perspective of the coaxial connector in accordance with an embodiment of the present invention.
Figure 3:
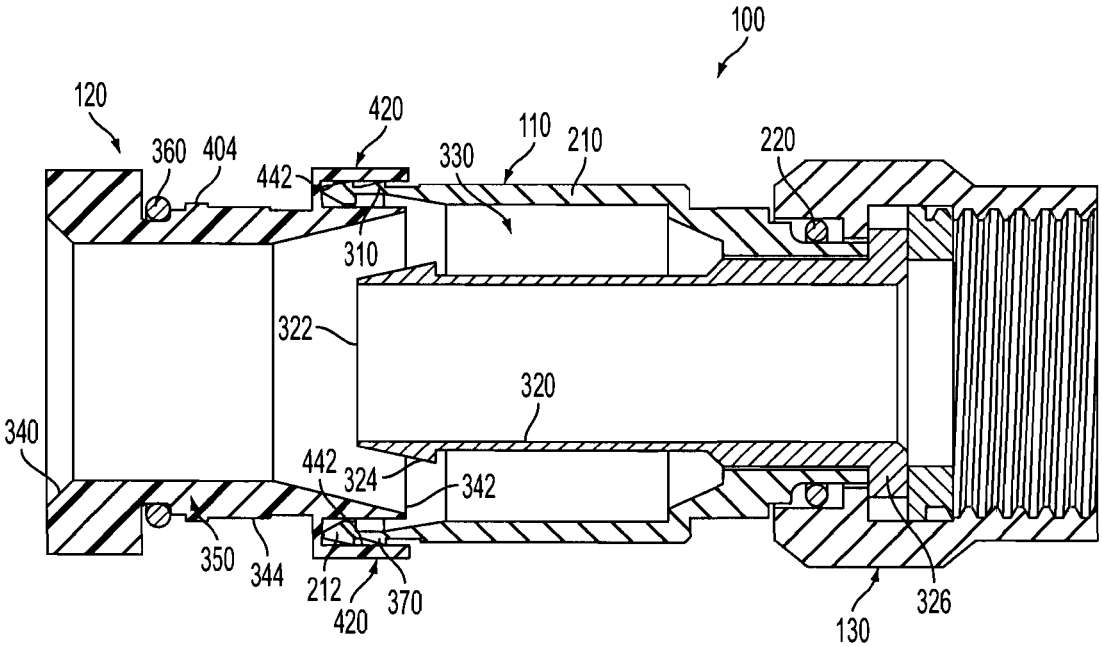
FIG. 3 is an enlarged cross-sectional view of the coaxial connector in accordance with an embodiment of the present invention, showing a locking sleeve of the connector in a first or holding position.

As best seen in FIGS. 1-3, the connector body 110 may include a main portion 210 that is substantially cylindrical in shape and that accepts the cable C. The main portion 210 has an outer surface 212 and includes opposite first and second ends 214 and 216. The main portion 210 is preferably formed of a conductive material, such as metal, preferably nickel or tin plated brass. The first end 214 is adapted to couple with the locking sleeve 120 and defines an installation opening 218 for receiving the cable C. The first end 214 may include an inner annular rib 310 for engaging cooperating structure of the locking sleeve 120. The second end 216 of the connector body 110 is configured to couple to the coupling nut 130 with a sealing ring 220 disposed in between, as is known in the art.

Received inside of the main portion 210 of the connector body 110 is a tubular inner post 320, as seen in FIG. 3. The inner post 320 extends from the body's second end 216 toward the installation opening 218. The distal end 322 of the inner post 320 includes an outwardly flared portion 324 for engaging the cable C. A base 326 of the inner post 320 opposite the distal end 322 provides an attachment of the inner post 320 between the connector body 110 and the coupling nut 130, as is known in the art. Defined between the main portion 210 and the inner post 320 is an inner annular receiving area 330 that is configured to receive a prepared end of the cable C and the end of the locking sleeve 120 to clamp the cable C, as is well known in the art.

Figure 4A:
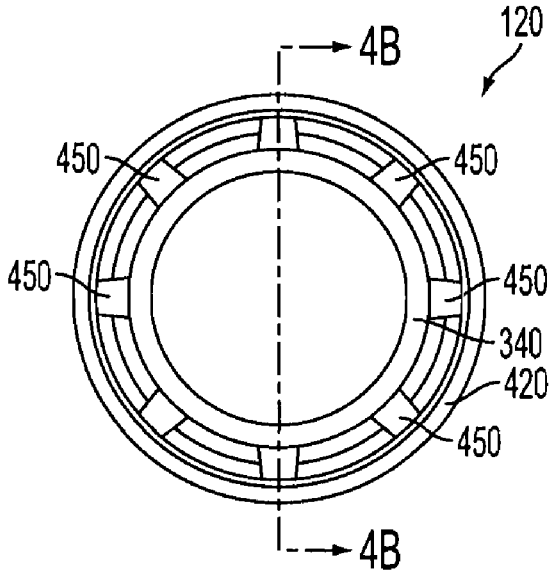
FIG. 4A is a end view of the locking sleeve of the coaxial connector illustrated in FIG. 3.
Figure 4B:
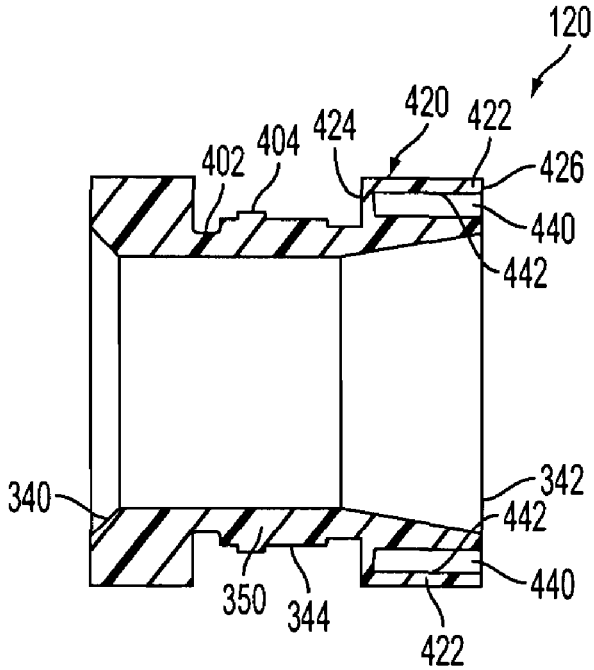
FIG. 4B is a cross-sectional view of the locking sleeve illustrated in FIG. 4A taken along line 4B-4B of FIG. 4A.
Figure 5A:
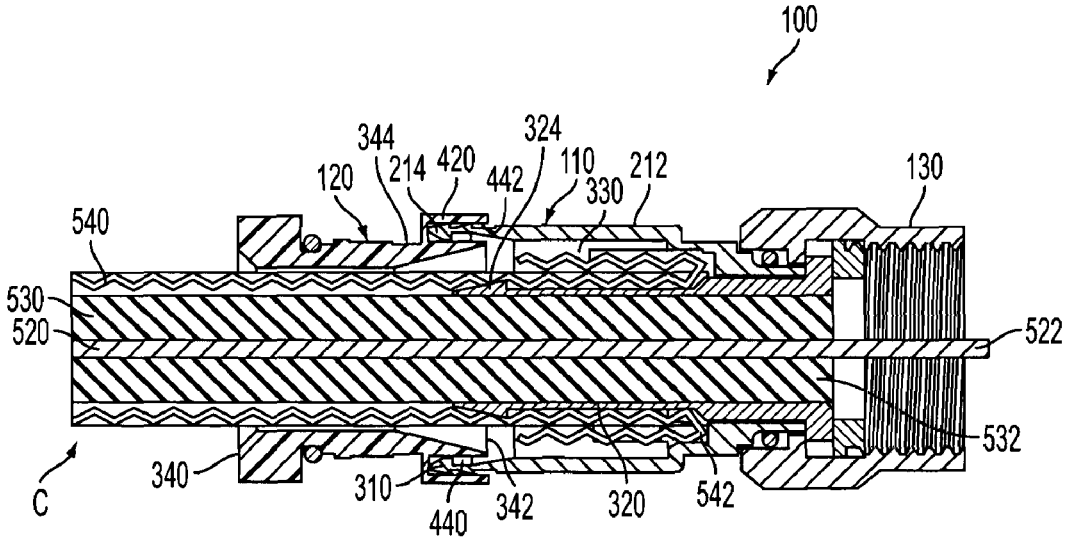
FIG. 5A is a cross-sectional view of the coaxial connector in accordance with an embodiment of the present invention, showing the connector assembled on a prepared end of the cable with the locking sleeve in the holding position.
Figure 5B:
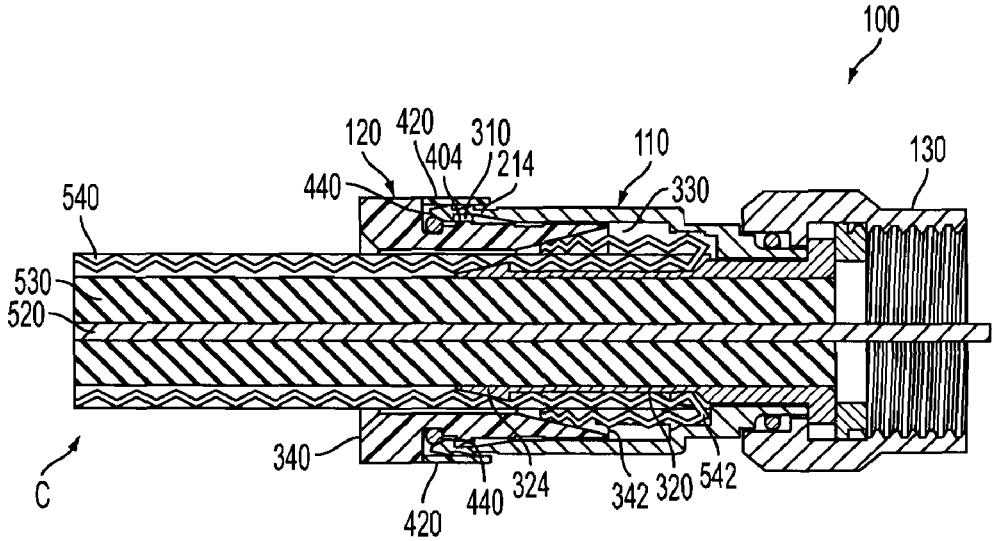
FIG. 5B is a cross-sectional view of the coaxial connector in accordance with an embodiment of the present invention, showing the connector assembled on the prepared end of the cable with the locking sleeve in a second or locked position.

As best seen in FIGS. 3, 4A and 4B, the locking sleeve 120 includes opposite first and second ends 340 and 342 and an outer surface 344. The locking sleeve 120 is preferably formed of a non-conductive material, such as plastic. The plastic may be resilient. Preferably the plastic material is polyethylene, PVC, acetal-copolymer, or the like. The first end 340 of the locking sleeve 120 is preferably flared to accept the cable C. The second end 342 is adapted to interface with the connector body 110 and is insertable into its inner annular receiving area 330. Between the first and second ends 340 and 342 is a cylindrical intermediate portion 350. The intermediate portion 350 may include an annular groove 402 adjacent the first end 340 of the sleeve 120, which accepts a sealing ring 360 (FIG. 3). An annular shoulder 404 is located adjacent the annular groove 402 and is adapted to snap engage the inner rib 310 of the connector body 110 when the locking sleeve 120 is moved into the locked position (FIG. 5B).

Extending radially from the outer surface of the first end 214 of the connector body 110 are a plurality of gripping members 370, such as barbs or the like. The gripping members 370 preferably extend continuously around the connector body's first end 214; however, the gripping members 370 may be discontinuous around the first end 214. The gripping members 370 are adapted to frictionally engage the locking sleeve 120.

The locking sleeve 120 preferably includes an outer engagement ring 420 that is spaced from the second end 342 of the locking sleeve 120. The outer engagement ring 420 facilitates coupling of the locking sleeve 120 to the connector body 110 in its first or holding position (FIG. 5A). The outer engagement ring 420 may include a wall 422 that extends substantially around the sleeve second end 342. The wall 422 is preferably continuous around the sleeve; however, it may be discontinuous, e.g. it may be formed in sections or fingers. The wall 422 may include opposite first and second faces 424 and 426 (FIG. 4B). The second face 426 of the wall 422 is preferably flush with the end of the locking sleeve 120, as seen in FIG. 4B. However, the second face 426 may extend beyond the end of the locking sleeve 120 or be set back from the end of the locking sleeve 120.

Between the second end 342 of the locking sleeve 120 and the spaced outer engagement ring 420 is an outer annular receiving area 440, as seen in FIG. 4B. More specifically, the outer annular receiving area 440 is defined between the inner surface 442 of the ring wall 422 and the outer surface 344 of the locking sleeve 120 at its second end 342. The outer annular receiving area 440 is shaped to accept the first end 214 of the connector body 110.

The inner surface 442 of the outer engagement ring 420 is adapted to frictionally engage the connector body's first end 214 via its plurality of gripping members 370, thereby creating an interference fit between the locking sleeve 120 and the connector body 110. The inner surface 442 is preferably smooth for engaging the gripping members 370 of the connector body 110. The inner surface 442, however, may not be smooth, and may be knurled, for example.

As seen in FIG. 4A, a plurality of frangible members 450 extend between the locking sleeve's outer ring 422 and the second end 342 of the locking sleeve 120. The frangible members 450 may be, for example, tabs having a thickness T (FIG. 4B) that allows the tabs 450 to break or shear off when the connector body's first end 214 is forced against the tabs 450. The tabs 450 may alternatively include weakened areas, perforations, and the like to provide the frangible feature. The tabs 450 are preferably radially spaced around the locking sleeve 120, as seen in FIG. 4A. Although eight tabs 450 are illustrated in FIG. 4A, any number of tabs 450 may be used, including only one tab.

Referring to FIGS. 5A and 5B, to terminate the connector 100 on the end of the cable C, the locking sleeve 120 and the connector body 110 may be assembled in the holding position prior to installing the cable C. Alternatively, the cable C may be first extended through the locking sleeve 120 and then the locking sleeve 120 may be assembled with the connector body 110 in the holding position.

In the holding position, as seen in FIG. 5A, the second end 342 of the locking sleeve 120 is detachably coupled to the first end 214 of the connector body 110 via an interference fit. More specifically, the connector body's first end 214 is inserted into the outer annular receiving area 440 of the locking sleeve's second end 342. The outer annular receiving area 440 is sized to tightly receive the connector body's first end 214 such that the gripping members 370 grab the inner surface 442 of the locking sleeve's outer engagement ring to form an interference or friction fit therebetween. While the first end 214 of the connector body 110 is received in the outer annular receiving area 440, the body's inner rib 310 rests on the outer surface 344 of the locking sleeve's second end 342. In this holding position, the interference fit holds the locking sleeve 120 on the connector body 110 so that it will not fall off of the connector body 110 during shipping and installation unless pulled off.

The end of the cable C is prepared for insertion into the connector 100 by removing layers of the cable C to expose an end 522 of its inner conductor 520, an end 532 of the surrounding insulation 530, and an end 542 of an outer braid 540 folded over the cable's jacket, as is well known in the art. The prepared end of the cable C may then be inserted through the first flared end 340 of the locking sleeve 120 and past the installation opening 218 (FIG. 2) of the connector body 110 until the inner post 320 engages the cable's prepared end. More specifically, the prepared end of the cable C is received in the inner post 320 such that the post's outwardly flared end portion 324 divides and is inserted between the insulation 530 and inner conductor 520 of the cable C and the folded portion 542 of the cable's braid 540, as seen in FIG. 5A.

Referring the FIG. 5B, the locking sleeve 120 is then moved axially with respect to the connector body 110 toward the coupling nut 130 to lock the connector 100 on the prepared end of the cable C. As the locking sleeve 120 is axially advanced, the first end 214 of the connector body 110 breaks or shears off the frangible tabs 450 of the locking sleeve 120. That allows the second end 342 of the locking sleeve 120 to be inserted into the connector body 110 and particularly into the inner annular receiving area 330, thereby clamping the folded over braid and cable jacket 542 between the second end 342 of the locking sleeve 120 and the flared end 324 of the inner post 320. The outer engagement ring 420, now separated from the frangible tabs 450, remains on the outer surface of the connector body's first end 214. To complete the locking of the connector 100 on the cable C, the inner rib 310 of the connector body 110 snaps behind the annular shoulder 404 of the locking sleeve 120. Once the connector 100 is terminated on the cable C, the coupling nut 130 may then be attached to a mating connector.

While a particular embodiment has been chosen to illustrate the invention, it will be understood by those skilled in the art that various changes and modifications can be made therein without departing from the scope of the invention as defined in the appended claims. For example, although it is preferable that the gripping members 370 are provided on the end of the connector body 110, the gripping members 370 may be provided on the locking sleeve 120 instead, such as on the inner surface 442 of the outer engagement ring.

What is claimed is:

1. A connector for terminating a coaxial cable, comprising of:

a connector body having opposite first and second ends, said first end being adapted to receive the coaxial cable and said second end being adapted to couple with a mating connector; and a locking sleeve having an interface end that is engageable with said first end of said connector body, said locking sleeve including an outer engagement ring spaced from said interface end thereby defining an outer annular receiving area between said outer engagement ring and said interface end, said outer annular receiving area being configured to receive the first end of said connector body in an interference fit, wherein said locking sleeve is axially moveable relative to said connector body between a holding position in which said locking sleeve is detachably coupled to said connector body and a locked position in which said locking sleeve is inseparably coupled to said connector body.

2. A connector according to claim 1, further comprising a plurality of gripping members extending from an outer surface of said first end of said connector body, said plurality of gripping members being adapted to engage an inner surface of said outer engagement ring.

3. A connector according to claim 2, wherein said plurality of gripping members are barbs.

4. A connector according to claim 1, further comprising a plurality of frangible members extending between said outer engagement ring and said interface end of said locking sleeve.

5. A connector according to claim 4, wherein said plurality of frangible members are a plurality of spaced radial tabs extending around said interface end of said locking sleeve.

6. A connector according to claim 1, further comprising a coupling nut attached to said second end of said connector body.

7. A connector according to claim 1, wherein an inner surface of said outer engagement ring is substantially smooth.

8. A connector according to claim 1, wherein said first end of said connector body is received in said outer annular receiving area in an interference fit when said locking sleeve is in said holding position.

9. A connector according to claim 1, wherein said connector body includes an inner annular rib that engages an annular shoulder of said locking sleeve when said locking sleeve is in said locked position.

10. A connector for terminating a coaxial cable, comprising of:

a connector body having opposite first and second ends, said first end being adapted to receive the coaxial cable and said second end being adapted to couple with a mating connector; and a locking sleeve having an interface end that is engageable with said first end of said connector body, said locking sleeve including an outer engagement ring spaced from said interface end and at least one frangible member disposed between said outer engagement ring and said interface end, said outer engagement ring being configured to engage said first end of said connector body in an interference fit, wherein said locking sleeve is axially moveable relative to said connector body between a holding position in which said locking sleeve is detachably coupled to said connector body and a locked position in which said locking sleeve is inseparably coupled to said connector body.

11. A connector according to claim 10, wherein said outer engagement ring and said interface end define an outer annular receiving area therebetween for receiving said first end of said connector body.

12. A connector according to claim 11, wherein said first end of said connector body is received in said outer annular receiving area in an interference fit when said locking sleeve is in said holding position.

13. A connector according to claim 10, wherein said connector body includes an inner annular rib that engages an annular shoulder of said locking sleeve when said locking sleeve is in said locked position.

14. A connector according to claim 10, wherein said at least one frangible member is a tab.

15. A connector for terminating a coaxial cable, comprising of:

a connector body having opposite first and second ends, said first end being adapted to receive the coaxial cable and said second end being adapted to couple with a mating connector;

a plurality of gripping members extending from an outer surface of said first end of said connector body;

a locking sleeve having an interface end that is engageable with said first end of said connector body, said locking sleeve including an outer engagement ring spaced from said interface end, and an outer annular receiving area being defined between said outer engagement ring and said interface end of said locking sleeve, said outer annular receiving area being configured to receive the first end of said connector body such that said plurality of gripping members of said first end of said connector body engage an inner surface of said outer engagement ring in an interface fit; and a plurality of frangible members extending between said interface end of said locking sleeve and said outer engagement ring, wherein said locking sleeve is axially moveable relative to said connector body between a holding position in which said locking sleeve is detachably coupled to said connector body and a locked position in which said locking sleeve is inseparably coupled to said connector body.

16. A connector according to claim 15, wherein said plurality of frangible members are a plurality of spaced radial tabs extending around said interface end of said locking sleeve.

17. A connector according to claim 15, wherein said plurality of gripping members are a plurality of barbs.

18. A method for terminating a coaxial cable, comprising the steps of:

providing a connector including a connector body with opposite first and second ends and a locking sleeve with an interface end, an outer engagement ring, and at least one frangible member therebetween;

inserting an end of the coaxial cable through the locking sleeve;

inserting the end of the end of the coaxial cable through the connector body;

coupling the interface end of the locking sleeve with a first end of the connector body via an interference fit;

inserting the locking sleeve into the connector body; and moving the locking sleeve axially relative to the connector body until the frangible member of the locking sleeve is severed, thereby detaching the outer engagement ring from the locking sleeve.

19. A method for terminating a coaxial cable according to claim 18, further comprising the step of:

preparing an end of the coaxial cable before inserting the coaxial cable through the locking sleeve.

20. A method for terminating a coaxial cable according to claim 19, further comprising the step of:

clamping the prepared end of the coaxial cable between the locking sleeve and an inner post of the connector body.

21. A method for terminating a coaxial cable according to claim 19, further comprising the step of:

inserting the coaxial cable into the locking sleeve either before or after the step of coupling the locking sleeve with the connector body.

22. A method for terminating a coaxial cable according to claim 19, further comprising the step of:

wherein the step of coupling the interface end of the locking sleeve with a first end of the connector body via an interference fit includes coupling the outer engagement ring of the locking sleeve with an outer surface of the first end of the connector body.

* * * * *